United States Patent [19]

Klebs

[11] 4,252,358

[45] Feb. 24, 1981

[54] HORIZONTAL GRAPPLE

[76] Inventor: James P. Klebs, 17834 Arcadia St., Lansing, Ill. 60438

[21] Appl. No.: 65,003

[22] Filed: Aug. 8, 1979

[51] Int. Cl.[3] ..... B66C 1/66

[52] U.S. Cl. ..... 294/67 BB

[58] Field of Search ..... 294/81 R, 67 R, 67 A, 294/67 AA, 67 BB, 103 CG, 103 R, 815 F, 88, 86 R, 78 A; 212/21, 127; 414/733, 732, 785

[56] References Cited

U.S. PATENT DOCUMENTS

| | | | |
|---|---|---|---|
| 2,815,547 | 12/1957 | Hedderich | 294/67 BB |
| 3,655,232 | 4/1972 | Martelee | 294/67 BB |

*Primary Examiner*—James B. Marbert

*Attorney, Agent, or Firm*—Philip Hill

[57] ABSTRACT

Grapple apparatus is provided for supporting and maintaining an unbalanced load in a substantially horizontal position, comprising a grapple beam fitted with movable arms, adapted for moving opposedly to engage or disengage a load and for moving concertedly along the beam to effect a balancing of the load, responsive to remote activation and control.

16 Claims, 5 Drawing Figures

Fig. 1.
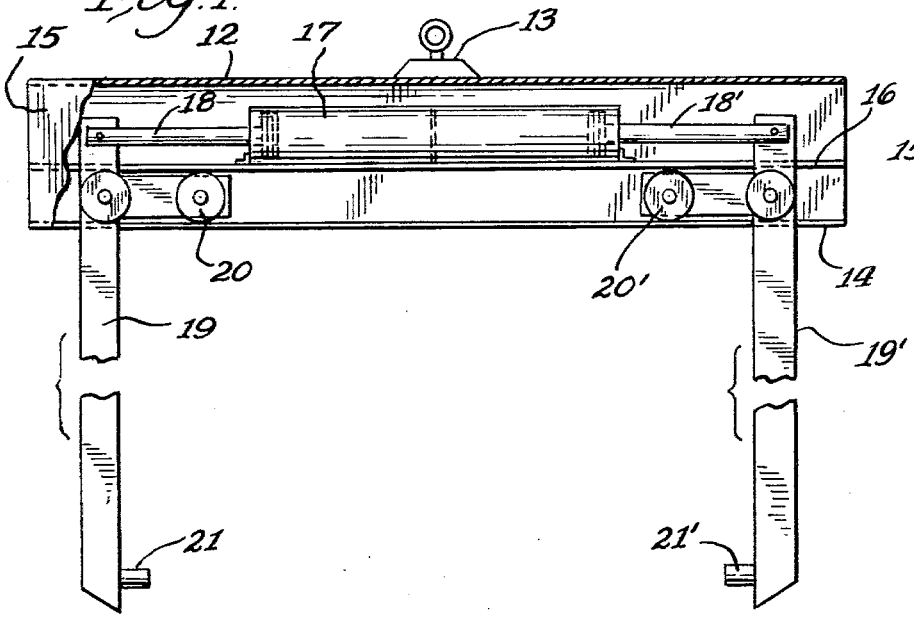
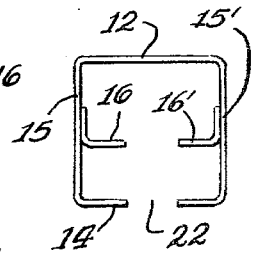
Fig. 2.
Fig. 3.
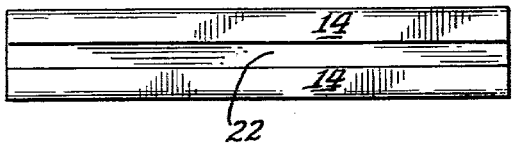
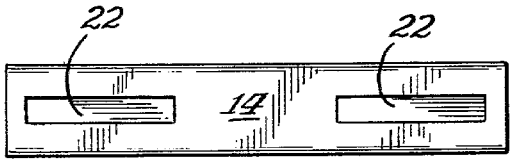
Fig. 4.
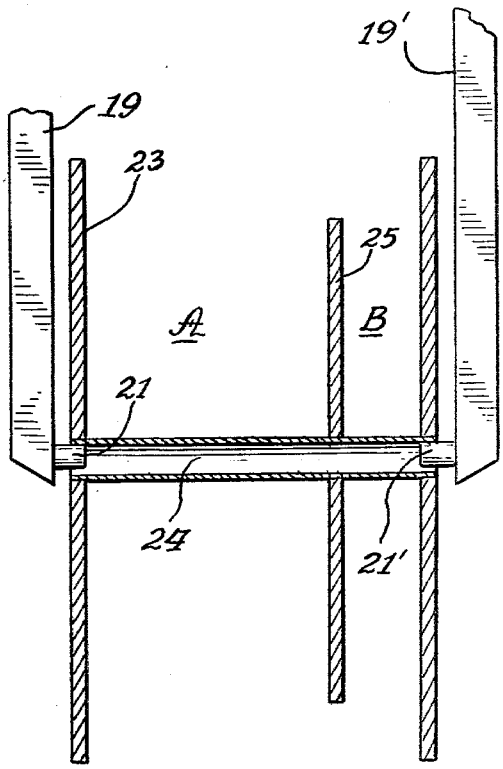
Fig. 5.

HORIZONTAL GRAPPLE

BACKGROUND OF THE INVENTION

A great variety of forks, slings and grapples have been developed in response to the varied and changing needs for equipment suited to the lifting, moving and supporting of heavy or bulky loads. A continuing problem relates to the handling of heavy loads whose bulk generally requires balancing as well as lifting. In one aspect of this problem, fork lift assemblies have been devised, as described in U.S. Pat. No. 3,863,971, which provide for a movable point of support capable of improving the balance of the load. In another aspect of this problem, reel lifting assemblies have been devised, as described in U.S. Pat. No. 3,549,190, which provide a series of spacer lugs along a spreader bar for roughly adjusting the positions of the lifting chains to bring the center of gravity of the reel into a generally balanced relationship with the spreader bar. Other lifting devices for reels are described in U.S. Pat. Nos. 3,343,861 and 3,583,753, respectively.

There remains a need for a lifting and positioning materials handling device for use with irregular or unbalanced loads where such loads must be balanced prior to their delivery to a work location or to a storage system. For example, telephone cable reels are periodically becoming larger in diameter, longer in axial dimensions, and much heavier in load. Additionally, recent developments in cable reel techniques have led to a preference for irregularly loaded reels.

SUMMARY OF THE INVENTION

This invention relates to a remotely controlled, horizontal grapple apparatus, and the method for employing the apparatus, for use with lifting means for supporting and positioning unbalanced loads, comprising:

(a) a substantially hollow, rectangular grapple beam, having substantially solid, planar top and side members, and a planar bottom member having a channel described lengthwise therethrough;

(b) swivel means, attached centrally to the top member of the beam and adapted to connect with the lifting means;

(c) hydraulic power means affixed to the beam and adapted to be activated and controlled from a remote location; and (d) two opposed grapple arm means, movably supported by the bottom member of the beam and extending downwardly through the channel therein, the respective grapple arm means being connected to the hydraulic power means and adapted for opposed or concerted longitudinal movement along a portion of the length of the channel in response to the remote activation and control of the hydraulic power means.

With the apparatus of this invention, the grapple may engage an unbalanced load by the opposed longitudinal movement of the respective grapple arm means for supportive movement of the unbalanced load, and, in consequence of the transporting and positioning movement of the lifting means, the beam may thereafter be establised in and maintained in a substantially horizontal plane by the concerted longitudinal movement of the respective grapple arm means suitably along the length of the channel in the bottom member of the beam, responsive to the activation of the remotely situated controls therefor.

The apparatus of this invention is particularly suitable for use in the laying of heavy telephone cable in underground ducts.

DESCRIPTION OF THE DRAWINGS

The attached drawings illustrate, without limitation, embodiments of this invention.

FIG. 1 provides a breakaway side view of the grapple beam and of the arrangement of the various items associated therewith.

FIG. 2 provides an end view of the grapple beam.

FIGS. 3 and 4 provide views of two embodiments of the bottom member of the grapple beam.

FIG. 5 illustrates one embodiment of the invention adapted for use with a cable reel having an off-center alignment.

DETAILED DESCRIPTION OF THE DRAWINGS

FIG. 1 provides a simplified breakaway view of the arrangements of the elements of this invention in one embodiment thereof. The grapple beam includes a planar top member 12 to which is attached swivel joint 13 adapted for connection to any convenient lifting means, not shown. The grapple beam also includes a planar bottom member 14 having an open channel running centrally through its length. Attached to the planar side member 15 is rail 16, parallel to the bottom member. A similar construction exists for the opposite side member, not shown. Shown in the breakaway view of the side member is a dual hydraulic power cylinder 17, mounted centrally along the rails and connected to remote control means, not shown. The respective hydraulic power units are adapted to activate piston rods 18 and 18' which are, in turn, connected to grapple arms 19 and 19'. Each grapple arm is fitted, respectively, with wheel means 20 and 20', adapted to move supportably on the bottom member of the beam along a portion described by the channel therein while restrained in vertical movement by the rails. The grapple arms are opposed to each other and are respectively fitted with supporting pins 21 and 21'. When moving opposedly, the grapple arms may either engage a load, or disengage a load, depending on the type of activation effected by the remote control means. After engagement of a load, the grapple arms may be moved concertedly to adjust the balance of the load, in response to remote control, to maintain the beam structure in a substantially balanced, horizontal position.

FIG. 2 provides a simplified end view of the structure of grapple beam 11, showing the respective alignments of top member 12, side members 15 and 15', rails 16 and 16', and bottom member 14. The central position of channel 22 along the length of the bottom member of the beam is also indicated.

FIG. 3 provides a simplified bottom view of the grapple beam, showing channel 22 extending along the entire length of the bottom member 14.

FIG. 4 provides a simplified bottom view of a second embodiment of the grapple beam wherein the channel 22 consists of two complementary openings along the length of bottom member 14, positioned to accomodate the full length of travel available to the respective grapple arms.

FIG. 5 is illustrative of the positioning of the grapple arms 19 and 19' after opposedly moving to engage as a load cable reel 23. The reel is supported on pins 21 and 21' which are inserted into hollow axle 24. The cable reel is compartmented by the insertion of separator 25 and, in practice, only the larger compartment A is loaded with cable (not shown) while the smaller compartment B is reserved for storing connector elements associated with an end section of the cable.

EMBODIMENTS OF THE INVENTION

The apparatus of this invention, and the method for its use, can be employed in a great variety of materials handling situations. A particularly desirable use involves the lifting, transporting, and supporting of heavy, unbalanced telephone cable reels, especially when installing cables underground where the load must be carefully balanced as the cable is gradually unreeled and fed into the duct.

The grapple apparatus of this invention is adapted to maintain its load in a horizontal, or balanced, plane in response to remote and continuously controllable positioning of the load, adjusting the alignment of its center of gravity in relation to the point of support of the grapple. Any suitable lifting apparatus may be employed, limited only by its capacity and maneuverability.

In a preferred embodiment of the grapple apparatus comprises a rectangular beam which is substantially hollow. As shown in FIGS. 1 and 2, the beam is formed to leave a longitudinal channel described throughout its length in its bottom member. Rails are attached, as by welding, to the side members of the beam structure, leaving a channel as in the bottom member, to provide a lower track and a supportive shelf for mounting additional equipment. For example, a hydraulic power system may be installed centrally along the grapple beam and supported upon the rails. The hydraulic system is adapted to be activated and controlled from a remote location such as, for example, a truck cab associated with the selected lifting means. The lifting means of whatever suitable type is engaged by a swivel joint, mounted centrally along the top side of the beam.

Grapple arms are adapted to depend through the beam channel from either side of the beam center of gravity. The grapple arms are preferably attached to wheel assemblies, which ride on the bottom member of the beam and below the rails, as well as to piston rods associated with the hydraulic power means. The grapple arms are long enough to reach at least to the midpoint of the height of any load. Depending upon the type of load and the available means for support, the opposed arms may be fitted, for example, with pins, as for engaging reels or axially supported loads, with tines, as for engaging pallet assemblies, or with formed plates, as for engaging bales or irregularly shaped loads. Such grapple arms are adapted to travel along a limited longitudinal section of the grapple beam, defined effectively by the stroke of the hydraulic piston rods. The length of traverse of the grapple arms is accordingly defined by the length of the grapple beam and the dimensions of the selected hydraulic system. Such parameters, of course, are determined in the first place by the dimensions intended to be encountered in the field, and can be designed within wide limits in response to a great variety of work situations.

In another embodiment of the invention, the channel in the bottom beam member is restricted to two slots, as shown in FIG. 4, which essentially define the longitudinal traverse available to each grapple arm system, or means.

In a preferred embodiment, the horizontal grapple apparatus is adapted for use with heavy telephone cable reels of a design which provides an unbalanced load. Such reels are constructed with an off-center divider, or separator, aligned on the axle of the reel, affording a larger compartment to be wound with the load of cable and a smaller compartment to receive cable connector means which is attached to one end of the wound cable. Use of such connectors significantly reduces the time spent in splicing cable in the field. In such "off-center" reels the effective cable load may be reduced to from about 65% to about 75% of the load normally associated with a standard reel.

In handling heavy cable reels, which may weigh up to about 14,000 pounds, and may vary in axial length up to at least about 54 inches and in diameter up to at least about 8 feet, a horizontal grapple beam of this invention can be suitably formed from heavy metal plate to provide a length of from about 72 to about 90 inches, with end dimensions being about 12 inches in width and from about 10 inches to about 12 inches in height. The preferred longitudinal traverse for each grapple arm should be from about 18 inches to about 30 inches, most preferably about 24 inches, in a channel from about 4 inches to about 6 inches wide.

When used in conjunction with a truck-mounted winch or crane, the grapple of this invention can be activated to lift a loaded cable reel from a storage area or from a truck bed, haul the reel to a work site, and move it into a working position such as, for example, substantially above a manhole associated with an underground cable duct system. The reel is engaged by opposedly moving the grapple arms, in response to activation of the hydraulic power system, to an open position whereby they may be dropped into place for engaging the respective support pins in the hollow axle assembly of the reel, followed by opposedly moving the grapple arms in the reverse direction to a closed, or lift, position whereby the arms fit snugly against the sides of the reel. In one preferred embodiment, the grapple arms may be additionally fitted with roller bearings to more readily accomodate movement of the reel about its axis. When an off-center reel is lifted, the grapple beam, supported from the swivel joint, will deviate from its desired horizontal position in response to the degree of imbalance imposed upon the system. In the practice of this invention, the grapple operator, stationed at a location remote from the grapple, can concertedly more the loaded grapple arms in the selected direction along the beam, so that grapple arms and loaded cable reel become positioned with their integral center of gravity in vertical alignment with the swivel joint. This concerted movement of the grapple arms thus effectively balances the load and brings the grapple beam back into the desired horizontal arrangement. By continued application of the hydraulic power, the positioning of the grapple arms may be maintained or varied as required to keep the grapple beam in horizontal alignment.

In practice, the grapple apparatus generally remains in a substantially horizontal alignment once the cable reel has been properly positioned, as above a manhole. Little or no adjustment is required as cable is paid out into the duct. Balanced positioning of the cable reel efficiently reduces the time required for pulling a unit of cable. Additionally, the use of such grapples has been recognized as effecting savings in transportation time.

While this invention has been described generally in terms of preferred embodiments, no limitation on its utility is to be inferred therefrom. The grapple apparatus of this invention may be employed in any lifting situation involving an initially unbalanced loading together with a need for achieving substantially balanced positioning thereafter.

I claim:

1. A remotely controlled, horizontal grapple apparatus, for use with lifting means for supporting and positioning unbalanced loads, comprising:

(a) a substantially hollow, rectangular grapple beam, having substantially solid, planar top and side members, and a planar bottom member having a channel described lengthwise therethrough;

(b) swivel means, attached centrally to the top member of the beam and adapted to connect with the lifting means;

(c) hydraulic power means affixed to the beam and adapted to be activated and controlled from a remote location; and (d) two opposed grapple arm means, movably supported by the bottom member of the beam and extending downwardly through the channel therein, the respective grapple arm means being connected to the hydraulic power means and adapted for opposed or concerted longitudinal movement along a portion of the length of the channel in response to the remote activation and control of the hydraulic power means.

2. The apparatus of claim 1 wherein each grapple arm means depends from wheel means supported by the bottom member of the beam.

3. The apparatus of claim 1 wherein the unbalanced load comprises a cable reel.

4. The apparatus of claim 3 wherein the cable reel includes distinct cable compartments having an off-center alignment.

5. The apparatus of claim 3 wherein the reel is a heavy telephone cable reel.

6. The apparatus of claim 1 wherein the unbalanced load is supported axially.

7. The apparatus of claim 1 wherein the unbalanced load is contained in a pallet assembly.

8. The apparatus of claim 3 wherein each grapple arm means includes a supporting pin means.

9. The apparatus of claim 6 wherein each grapple arm means includes a supporting pin means.

10. The apparatus of claim 7 wherein each grapple arm means includes a pallet assembly support means.

11. The method of maintaining a grapple apparatus in a substantially horizontal plane while lifting, supporting, and positioning an unbalanced load, comprising the steps of:

(a) engaging the unbalanced load with two opposed grapple arm means depending from a grapple beam, fitted with swivel means attached to lifting means, each grapple arm means moving in a channel described along a portion of the length of a bottom member of the beam in response to remotely controlled hydraulic power means affixed to the beam; and (b) thereafter maintaining the beam in a substantially horizontal plane by concerted movement of the two grapple arm means suitably along the length of the channel responsive to the hydraulic power means.

12. The method of claim 11 wherein the unbalanced load comprises a cable reel.

13. The method of claim 12 wherein the cable reel includes distinct cable compartments having an offcenter alignment.

14. The method of claim 12 wherein the reel is a heavy telephone cable reel.

15. The method of claim 11 wherein the unbalanced load is engaged and supported through axial means.

16. The method of claim 11 wherein the unbalanced load is engaged and supported through pallet assembly means.

* * * * *